United States Patent [19]

Carroll

[11] 3,987,748

[45] Oct. 26, 1976

[54] MARINE VESSEL ADAPTED TO BE POWERED AND STEERED BY A TRANSPORTED LAND VEHICLE

[76] Inventor: Charles A. Carroll, 5860 Cowell Road, Brighton, Mich. 48116

[22] Filed: June 9, 1975

[21] Appl. No.: 585,260

[52] U.S. Cl. ..... 115/.5 A
[51] Int. Cl.[2] ..... B63H 25/00
[58] Field of Search ..... 115/.5 A, 1 R, 34 A

[56] References Cited

UNITED STATES PATENTS

| | | | |
|---|---|---|---|
| 1,333,447 | 3/1920 | Ross | 115/.5 A |
| 1,568,307 | 1/1926 | Acocella | 115/.5 A |
| 2,997,012 | 8/1961 | Özkök | 115/.5 A |
| 3,599,593 | 8/1971 | Fleming | 115/.5 A |
| 3,709,186 | 1/1973 | Gotmalm | 115/34 A |

FOREIGN PATENTS OR APPLICATIONS

| | | | |
|---|---|---|---|
| 1,445,795 | 6/1965 | France | 115/.5 A |
| 339,524 | 8/1959 | Switzerland | 115/.5 A |

*Primary Examiner*—Trygve M. Blix
*Assistant Examiner*—Stuart M. Goldstein
*Attorney, Agent, or Firm*—Olsen and Stephenson

[57] ABSTRACT

A marine vessel that is constructed and arranged so that it can accommodate an automobile or other motor vehicle and can simply and efficiently utilize the power drive and steering mechanisms of the motor vehicle for the propulsion and steering of the vessel. The motor vehicle can be carried on the deck of the vessel, and to standardize construction of the vessel, a fixed location for only one supporting element for a steering wheel is provided. The remaining wheels are supported on movable elements that can be located to accommodate a motor vehicle of any width and length. The wheel supporting element that has a fixed location is a turntable which is connected to a rudder, so that the rudder can be controlled by operation of the steering wheel of the motor vehicle. A hydraulic propulsion system is provided which can be driven from a movable supporting element that supports a driving wheel of the motor vehicle.

18 Claims, 15 Drawing Figures

MARINE VESSEL ADAPTED TO BE POWERED AND STEERED BY A TRANSPORTED LAND VEHICLE

BACKGROUND OF THE INVENTION

The present invention relates to a marine vessel of the type that is adapted to carry a motor vehicle and to utilize the power drive and steering mechanism of the motor vehicle for propelling and steering the vessel.

Large luxury power boats are desired by many people, but there are relatively few that can afford the initial acquisition cost or the upkeep of these pleasure crafts. Most people own an automobile, and there are many features therein that are common to those that are desirable to have in a pleasure boat. For example, an automobile provides a powerful engine; a transmission for forward, reverse or neutral modes of operation; a cabin with windows and doors; fixtures such as a radio, heater, air conditioner, windshield wiper, horn, and the like; provisions for steering; electrical features, such as head lights, instrument lights, cabin lights, a starter, generator/alternator, battery, and the like; comfortable interiors, such as upholstered seats, and many other useful items. Thus, luxury power boats are within the financial reach of many people who otherwise could not afford them if a practical solution can be provided for the mating of an auotmobile, a recreational vehicle, or the like with a marine vessel which contains the other essential elements for a luxury power boat not found in the motor vehicle.

The concept of utilizing the power drive and steering mechanism of a motor vehicle for propelling and steering a marine vessel has been known in the prior art for many years. One such arrangement is disclosed in U.S. Pat. No. 1,568,307, issued Jan. 5, 1926 to Acocella which discloses the broad concept of utilizing the drive from the rear wheels for propelling the craft and which has turntables on which the front wheels are positioned to enable the occupant of the motor vehicle to steer the marine vessel. Another similar disclosure is found in U.S. Pat. No. 1,380,319, issued May 31, 1921 to Houseman, et al. This patent discloses a similar arrangement wherein features are also provided for adjustment longitudinally of the wheel support means to accommodate vehicles of different lengths.

The various prior art teachings existing in this field have not been adequate to serve the needs of the public, and as a result, commercially successful marine vessels of the type contemplated herein have not been produced. This has been the result of many imperfections that exist in the prior art devices, such as the lack of adaptability of the marine vessels to accommodate motor vehicles of different sizes so that a single standard marine vessel can be built which will serve all vehicles irrespective of the size of the wheels, the spacing between wheels both laterally and in a fore and after direction, the type of propulsion provided by the vehicle, and the like. Not only is there a need for improved features which will enable the user to readily adjust his marine vessel to accommodate any motor vehicle, but it is also necessary that the propulsion system be arranged so that it can accommodate the various types of motor vehicles now on the market with a minimum of effort and cost on the part of the user.

SUMMARY OF THE INVENTION

The present invention has overcome the inadequacies of the prior art and provides a marine vessel that is characterized by its simple design and its adaptability to wide variations in automobile dimensions so that the marine vessel can readily be produced by mass production techniques and will meet the requirements for use with the various motor vehicles now on the market. According to the present invention only one wheel of the motor vehicle is required to drive the propeller, and power from the single wheel can be transmitted by fluid power through flexible hoses. This, then, no longer requires that the drive wheel be located in one specific location, and the other wheel can then be chocked, so that varying widths of the vehicle poses no problem. Given the freedom of random location of the single rear drive wheel, the steering turntable for the one front wheel can then be permanently located and the control linkage to the rudder does not have to be touched during the mating process of the automobile with the marine vessel. This provides the added advantage of safety, because the critical steering linkage does not require that it be disconnected, adjusted, and reconnected, during each usage of the marine vessel. As can be understood, since the turntable for the one front wheel is fixed in position and linked to the rudder, the turntable for the other front wheel can be a dummy with no linkage required. This simplistic feature permits it to be suitably installed in a guide channel so that it can be quickly and easily moved laterally to align it with the other front wheel when the steering front wheel is about to enter onto its live turntable.

Thus, according to a preferred form of the present invention, a marine vessel is provided that comprises a deck, a live turntable mounted on the deck in a fixed location and having support and positioning means for one front steering wheel of a motor vehicle. A dummy turntable is positioned on the deck and is laterally movable for selective positioning to support the other front wheel of the motor vehicle. A rudder is provided, and steering gear means connect the live turntable with the rudder for turning the rudder in response to turning of the live turntable. Retaining means selectively positioned on the deck to accommodate and to secure the vehicle ganst fore and aft movement are provided, and rotary drive means for selective positioning on the deck in juxtaposition to the rear drive wheel of the vehicle are also provided so as to be rotated in response to turning of the rear drive wheel. A fluid pump for the propulsion system is connected to the rotary drive means to be turned thereby. A propeller is provided, the fluid motor means being connected to the propeller for driving purposes. Coupling means are connected to the pump and to the fluid motor means for supplying fluid for driving the motor means in response to turning of the pump. The coupling means can be flexible hoses so that the rotary drive means for the propulsion system can be positioned in any desired location on the deck to accommodate a vehicle of any construction or size.

Thus, it is an object of the present invention to provide an improved marine vessel adapted to accommodate motor vehicles of a variety of sizes and constructions and which is characterized by the simplicity of its construction so as to make it suitable for general use by the public and so that it is readily adapted to be manufactured as a standard item for mass production purposes.

Other objects of this invention will appear in the following description and appended claims, reference being had to the accompanying drawings forming a part of this specification wherein like reference characters designate corresponding parts in the several views.

DESCRIPTION OF THE PREFERRED EMBODIMENTS

Figure 1:
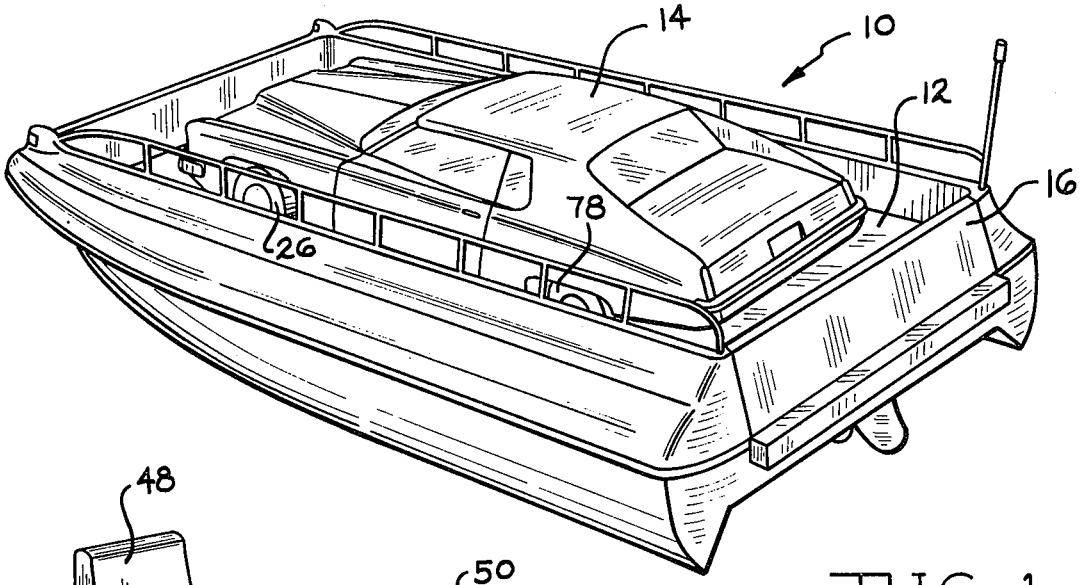
FIG. 1 is a perspective view of a motor vehicle mounted on a marine vessel embodying the present invention.
Figure 3:
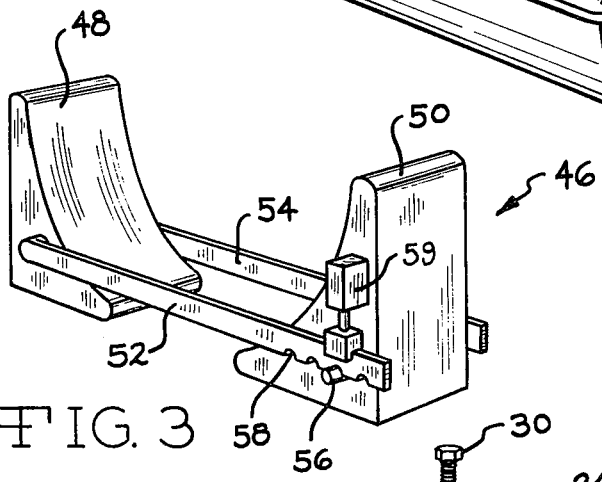
FIG. 3 is an enlarged perspective view of one form of a rear wheel support means for positioning on the deck of the marine vessel.
Figure 4:
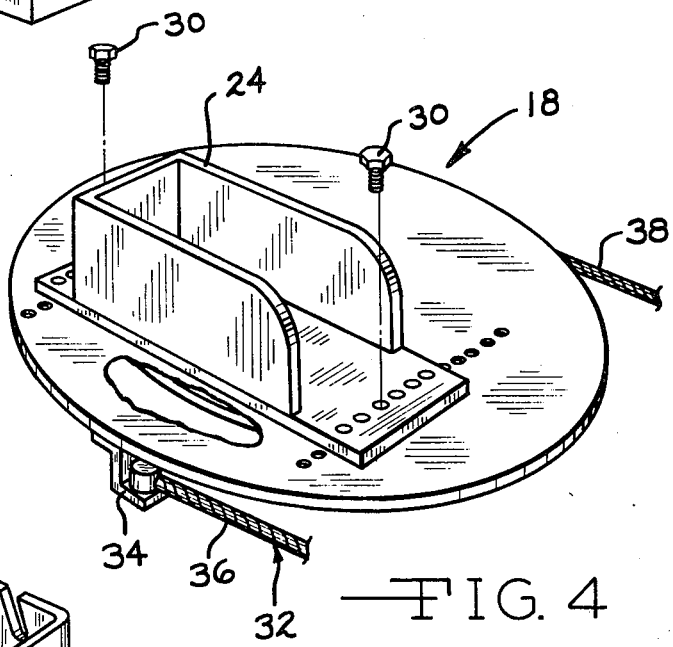
FIG. 4 is an enlarged fragmentary perspective view showing the live turntable for supporting the left front wheel of the motor vehicle and showing portions of the steering gear that extends to the rudder.

Referring now to the drawings, the invention will be described in greater detail. The marine vessel 10 has a deck 12 adapted to receive a motor vehicle 14 in a position such as is shown in FIG. 1. The marine vessel 10 has a stern gate 16 which can be lowered to provide a ramp for loading and unloading of the motor vehicle 14. Mounted on the deck 12 in a fixed location is a live turntable 18, and also located in a fixed relation on the deck 12 is the transverse rail means 20 which is essentially in alignment with the axis of turning of the live turntable 18. Positioned on the transverse rail means 20 for rotation about its vertical axis is a dummy turntable 22 which is laterally shiftable to accommodate vehicles having different wheel treads or spacing between the front wheels.

The live turntable 18 has secured to its upper surface the support and positioning means 24 for receiving one front steering wheel 26 of the motor vehicle 14. The dummy turntable 22 has a similar support means 28 for receiving the other front steering wheel (not shown) of the motor vehicle 14. Because of the free lateral movement that can occur by the dummy turntable 22 on the transverse rail means 20, the dummy turntable 22 can readily be shifted to a position in alignment with the other front steering wheel as the one front steering wheel 26 is being advanced into the support means 24. Thus, both front wheels will be supported on turntables for turning in response to turning of the steering gear of the motor vehicle 14.

As is conventional with motor vehicles 14, the front wheels are not turned on a vertical axis passing directly through the wheels but on pivots of short radius located inward of each wheel. To accommodate this small radius of turning, the support and positioning means 24 can be positioned slightly off center with respect to the axis of the turntable 18 by means of the fastening screws 30. Also, for the purpose of utilizing the live turntable 18 to operate the steering gear 32 of the marine vessel 10, bracket means 34 are connected to the underside of the turntable 18 to which cable ends 36 and 38 of the steering gear 32 are connected. As previously indicated, the turntable 22 is not connected to the steering gear and is free to pivot about its vertical axis in the transverse rail means 20.

The steering gear 32 includes the rudder 40 which is mounted for turning on the shaft 42, and the latter is adapted to be rotated by the wheel 44 around which the cable ends 36 and 38 extend. Thus, it can be seen that when the live turntable 18 is rotated about its axis it will turn the rudder 40 accordingly, and thereby enable the operator of the motor vehicle 14 to steer the marine vessel 10 when it is under way.

Positioned on the deck to accommodate and secure one rear wheel (not shown) of the vehicle 14 is the retaining means 46 which can be positioned on deck 12 in a suitable location so as to secure the one wheel (not shown) against fore and aft movement. In the illustrated form of the invention the retaining means 46 is a chock which has fore and aft members 48 and 50 secured together by the linkages 52 and 54. The after chock member 50 has a pair of pins 56 projecting laterally outwardly therefrom over which the linkages 54 and 56 can be positioned with one of the notches 58 straddling the pin 56 to be locked thereon by the locking device 59 for setting the spacing between the fore and aft chock members 48 and 50. This feature of adjustment can be utilized so that the retaining means 46 is suitable for use with wheels of different diameters. It is to be understood that the retaining means 46 can be located on the fore and aft sides of the wheel of the motor vehicle 14 after the latter has been advanced onto the deck in the position shown in FIG. 1. A suitable gripping surface 60 can be provided on the deck 12 to aid in holding the retaining means 46 in place. Other suitable means can also be used for this purpose.

Figure 5:
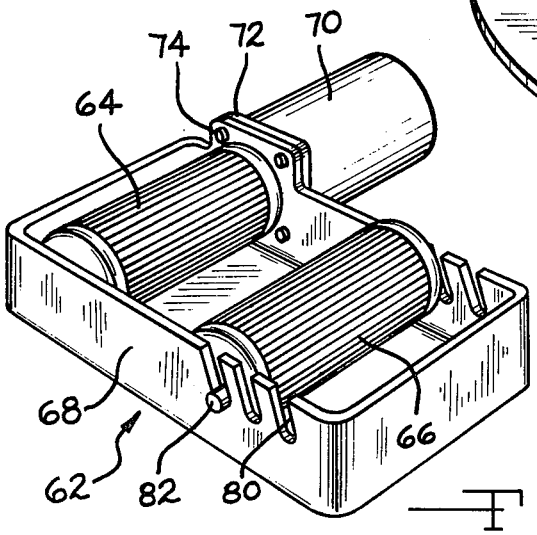
FIG. 5 is a perspective view of a rear wheel support means to which is connected a fluid pump for use in driving the propeller of the marine vessel.
Figure 2:
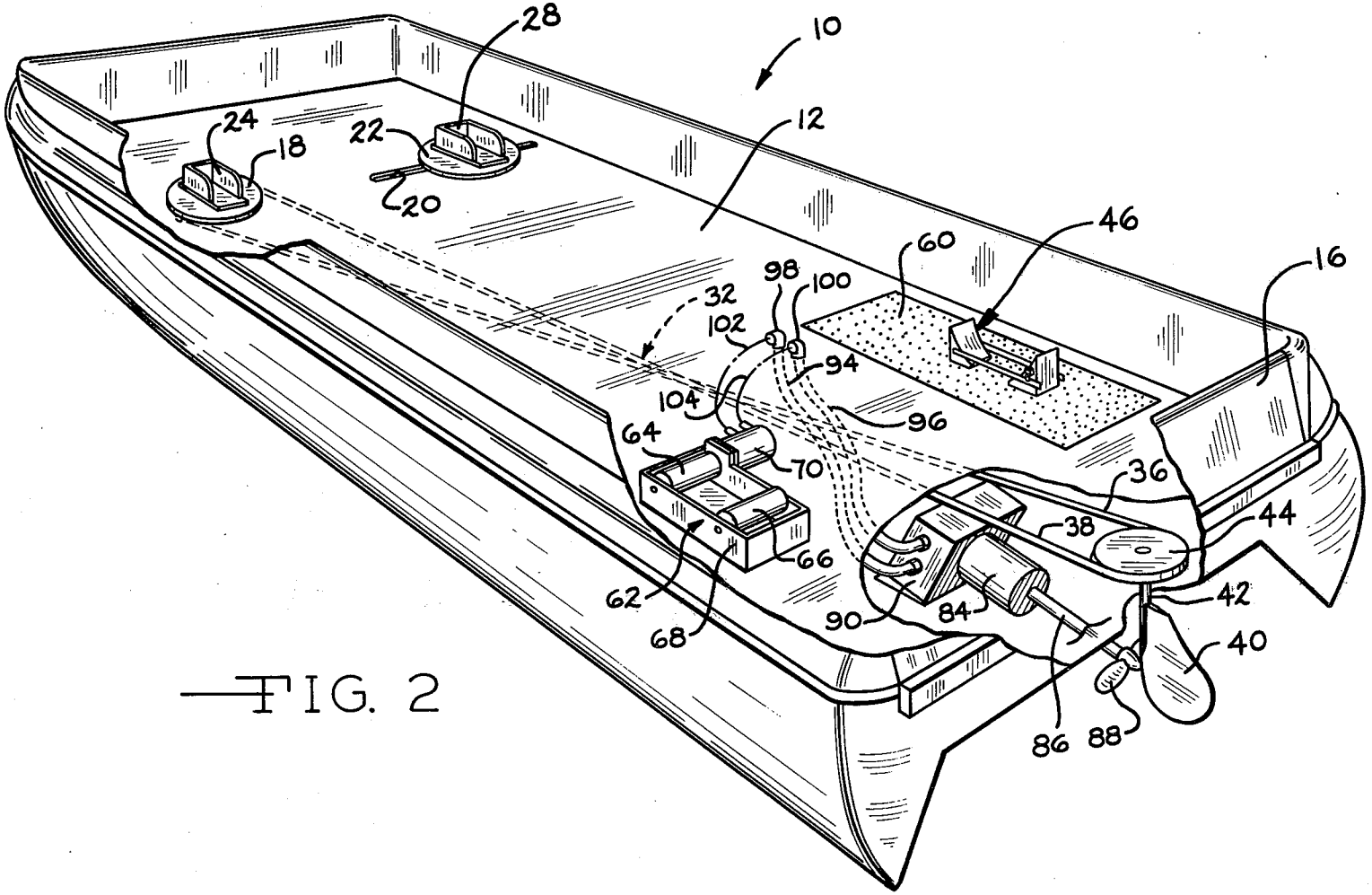
FIG. 2 is an enlarged perspective view of the marine vessel with portions broken away to illustrate details of construction of the marine vessel.

Also positioned on the deck 12 is the rotary drive means 62 which includes the pair of rollers 64 and 66 retained in the frame 68. Connected to the roller 64 for rotation therewith is the hydraulic or fluid pump 70. The fluid pump 70 includes an end plate 72 which is secured to the frame 68 by a plurality of screws 74, and the shaft of the hydraulic pump 70 is connected to the shaft of the roller 64 for rotation therewith. The frame 68 and the rollers 64 and 66 serve as a retaining means for the rear wheel 78 of the motor vehicle 14, and in those instances wherein the motor vehicle 14 has a limited slip differential in its rear axle assembly for providing drive through both rear wheels, the retaining means 46 can be replaced by a retaining means having the same construction as the rotary drive means shown in FIG. 5, but with the hydraulic pump 70 removed. As shown in FIG. 5, the retaining means portion of the rotary drive means 62 provides for fore and aft adjustment of the spacing between the rollers 64 and 66. For this purpose the frame 68 has a plurality of slots 80 in which the shaft 82 of the roller 66 can be selectively positioned, thereby varying the spacing between the rollers 64 and 66 to accommodate wheels of different diameters of the motor vehicle that is to be transported in the marine vessel 10.

The propulsion system includes the hydraulic motor 84 which is in driving relation to the propeller shaft 86 on which is mounted the propeller 88. Hydraulic control means to be described are located at 90 and have connected thereto the conduits 94 and 96 which connect to the deck fittings 98 and 100. The latter are then connected by flexible hoses or conduits 102 and 104 to the hydraulic pump 70 for receiving and returning hydraulic fluid to the motor 84. Because of the flexible nature of the hoses or conduits 102 and 104, the rotary drive means 62 and the hydraulic pump 70 can readily be moved to any position on the deck to accommodate or to be in juxtaposition to the rear drive wheel 78 so that the power drive of the motor vehicle 14 can be used to supply the necessary power for turning the propeller 88. For this purpose, it is merely necessary to jack the rear end of the motor vehicle 14 and the rotary drive means can then be placed under the raised rear wheel 78, and upon lowering the latter, the wheel will be in driving relationship to the roller 64. Thus, the driving wheels of the motor vehicle 14 can easily be placed in driving relationship to the rotary drive means 62, and very little adjustment or skill is required on the part of the operator to accomplish this end. Also, a fluid drive system is provided so that the rotary drive means 62 can be positioned any where on the deck 12 with respect to the live turntable 18 to accommodate a motor vehicle of any wheel base or wheel tread.

Figure 6:
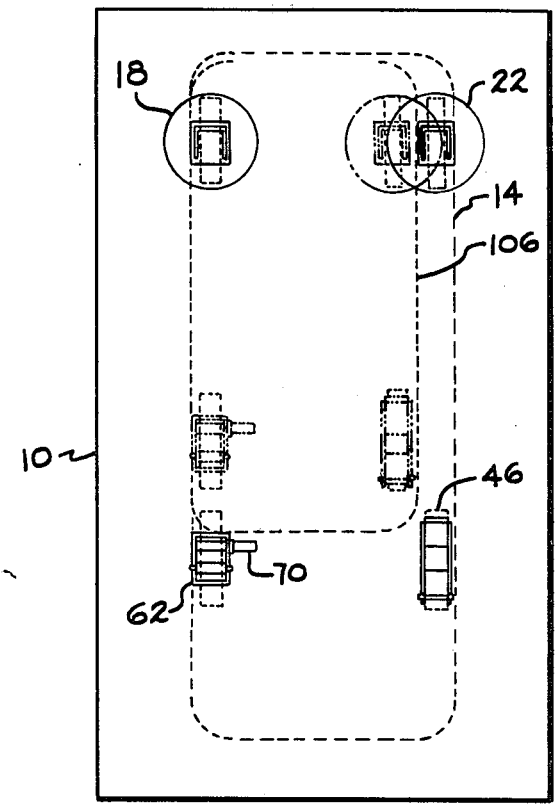
FIGS. 6, 7, 8, 9 and 10 are schematic illustrations showing various arrangements for accommodating a variety of different motor vehicles on the marine vessel.
Figure 7:
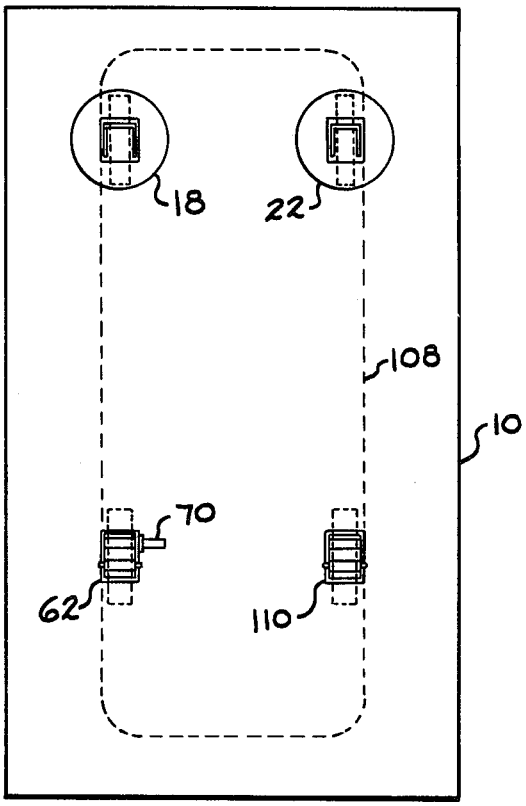

Referring to FIGS. 6–10, inclusive, it will be seen that the marine vessel 10 can very easily be used in conjunction with a variety of different types of motor vehicles which also may have a different dimensions. As can be seen in FIG. 6, the motor vehicle 14 is shown in dotted lines in conjunction with the live turntable 18, the dummy turntable, the retaining means 46 and the rotary drive means 62. If a smaller vehicle 106 were to be driven onto the deck 12, the same corresponding parts 22, 46 and 62 could be utilized in conjunction with the wheels thereof, after relocating these corresponding parts to fit the dimensions of the motor vehicle 106. The motor vehicle 108 as shown in FIG. 7 represents diagramatically a motor vehicle 108 which has limited-slip rear axle differential, for it requires a retaining means 110 constructed the same as the rotary drive means 62, except that the hydraulic pump 70 has been omitted. In other respects, the live turntable 18 and the dummy turntable 22 will be used as previously described.

Figure 8:
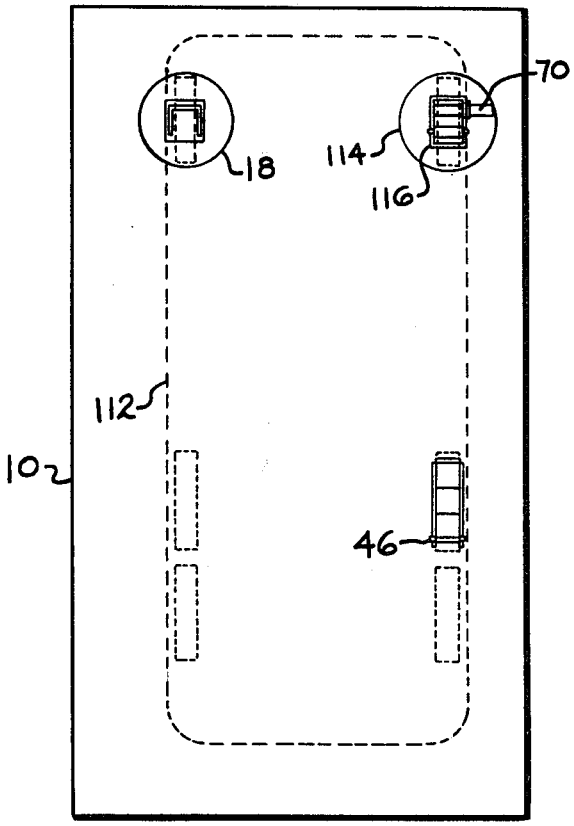

Referring now to FIG. 8, a schematic diagram is shown of a motor vehicle 112 which has a front wheel drive, and for this purpose the dummy turntable 114 is provided with a rotary drive means 116 and a hydraulic pump 70 for use as a propulsion means. Suitable retaining means 46 can then be used in conjunction with the rear wheels of the motor vehicles. As can be seen in FIG. 8, the motor vehicle 112 can be provided with tandem rear wheels and can still be readily carried by the marine vessel 10.

Figure 9:
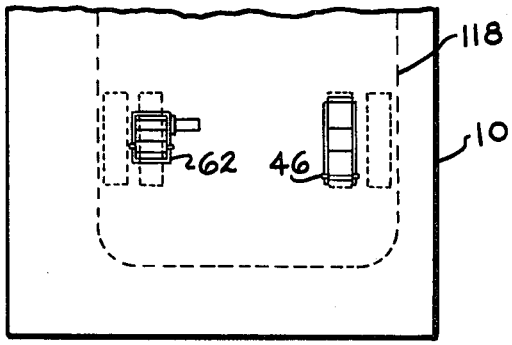
Figure 10:
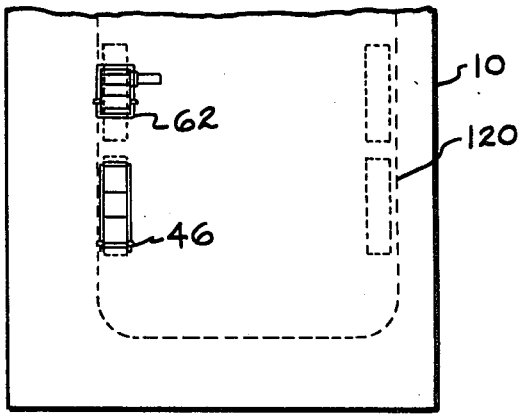

FIG. 9 shows another vehicle 118 which has dual rear wheels, and for this purpose the rotary drive means 62 can be positioned under the inner wheel and the retaining means 46 can be positioned under the opposite inner wheel. FIG. 10 shows still another type of motor vehicle 120 wherein the rotary drive means 62 can be positioned under a forward rear tandem wheel and the retaining means 46 can be positioned under the rearward of the two rear tandem wheels.

Figure 11:
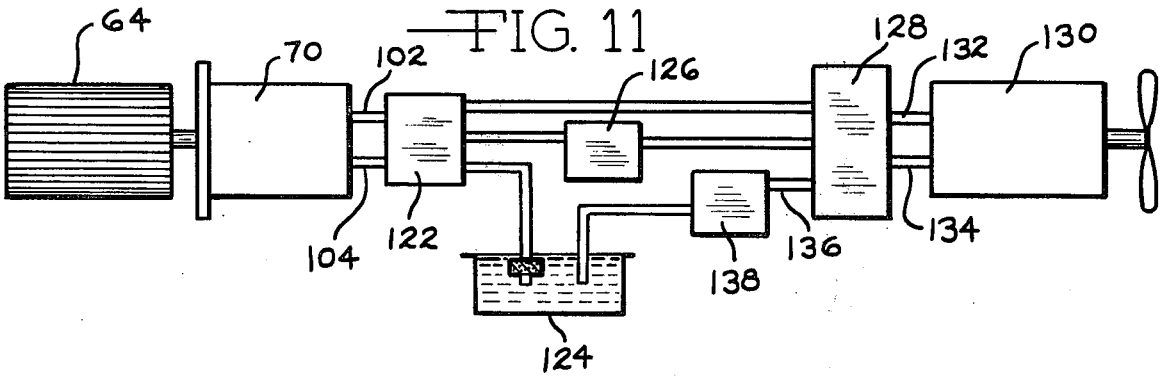
FIG. 11 is a schematic illustration of one form of propulsion system that can be utilized with the marine vessel.

Attention is next directed to FIG. 11 for a brief description of one fluid drive system that may be used in conjunction with the present invention. As there shown, the roller 64 is drivingly connected to the hydraulic or fluid pump 70. The latter is connected by the flexible hoses or conduits 102 and 104 to a spool valve 122. The conduit 102 will serve as the high pressure line when the roller 64 is moved in a forward direction, and the conduit 104 will serve as the high pressure line when the roller 64 is turned in the reverse direction. In each of these instances, the other line will then serve as the return to tank 124. The high pressure fluid will flow through the pressure reducing valve 126 to the spool valve 128 then to the hydraulic motor 130 via the conduit 132. The return flow from the hydraulic motor 130 will be via the conduit 134, spool valve 128, conduit 136, heat exchanger 138 to tank 124.

Figure 12:
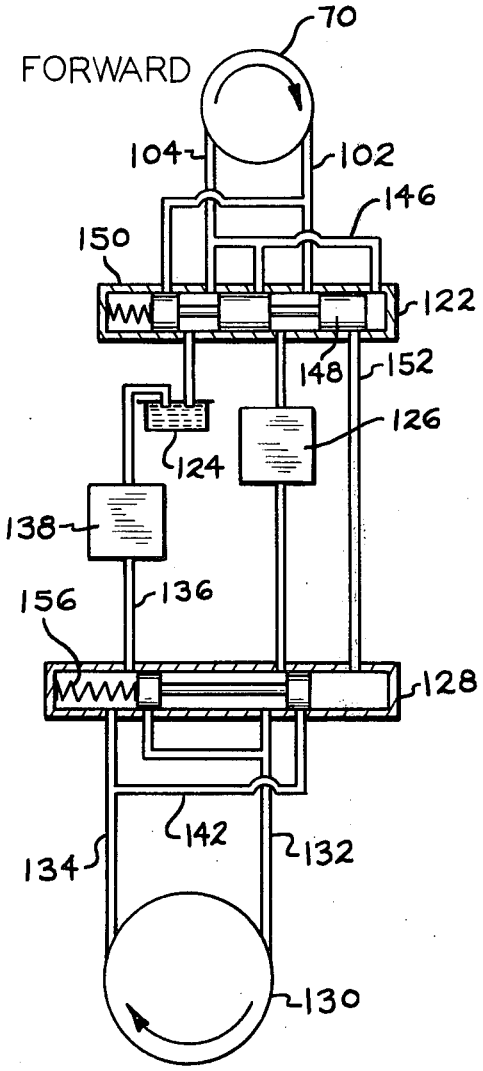
FIG. 12 is a schematic sectional illustration showing the fluid circuits of the propulsion system when the rotary drive means or pump is turned in a forward direction.
Figure 13:
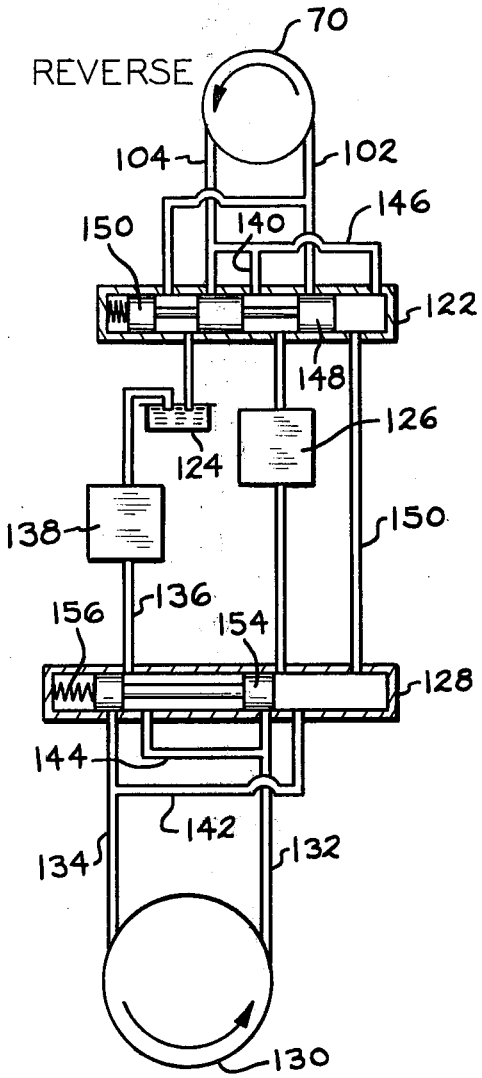
FIG. 13 is a similar view showing these components when the rotary drive means and pump are turned in a reverse direction.

FIG. 12 discloses the normal flow of the hydraulic fluid when the drive wheel of the motor vehicle 14 is turning in a forward direction. As there shown, the hydraulic fluid under pressure will then flow through the conduit 102 through the spool valve 122, through the pressure reducing valve 126, through the spool valve 128 and via the conduit 132 to the hydraulic motor 130. The return flow of fluid will then pass through the conduit 134, the spool valve 128, the conduit 136 and heat exchanger 138 to the tank 124. FIG. 13 shows a similar cycle of operation but in the reverse direction starting at conduit 104 and then through conduit 140, spool valve 122, pressure reducing valve 126, to spool valve 128, conduit 142, and via 134 through the hydraulic pump 130. The fluid will be returned via conduit 132, conduit 144, spool valve 128 and then through conduit 136, heat exchanger 138 to tank 124.

To facilitate shifting the direction of flow of fluid when the direction of turning of pump 70 occurs, a conduit 146 is provided so that fluid will act on the right end of the piston 148 shifting it to the left position shown, against the action of the spring 150. When the direction of pump 70 is returned to the direction shown in FIG. 12, the spring 150 will shift the spool valve to the right so that the piston 148 then assumes the position then shown in FIG. 12 closing the conduit 152. The latter serves to supply fluid under pressure to the spool valve 128 to shift the piston 154 to the left to the position shown in FIG. 13 against the spring 156 for use in reverse flow through the conduit 142, but when the pump 70 is reversed to its forward position, the spring 156 will then return the spool valve to the position shown in FIG. 12. Thus, it can be seen that the fluid propulsion system permits ready use of the reverse and forward control system of the motor vehicle 14 to enable the marine vessel 10 to be moved forward or in reverse.

Figure 14:
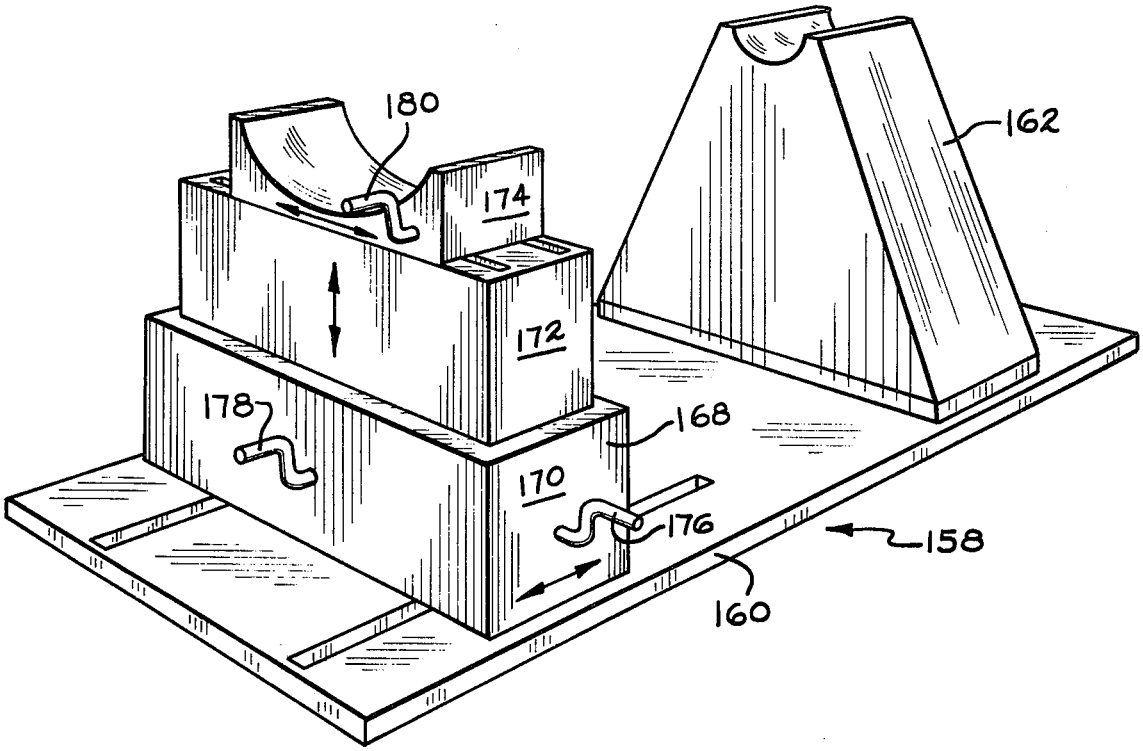
FIG. 14 is a perspective view showing still another form of the invention wherein a support means is provided for a drive axle of a vehicle and an adjustable support is provided for the pump means.
Figure 15:
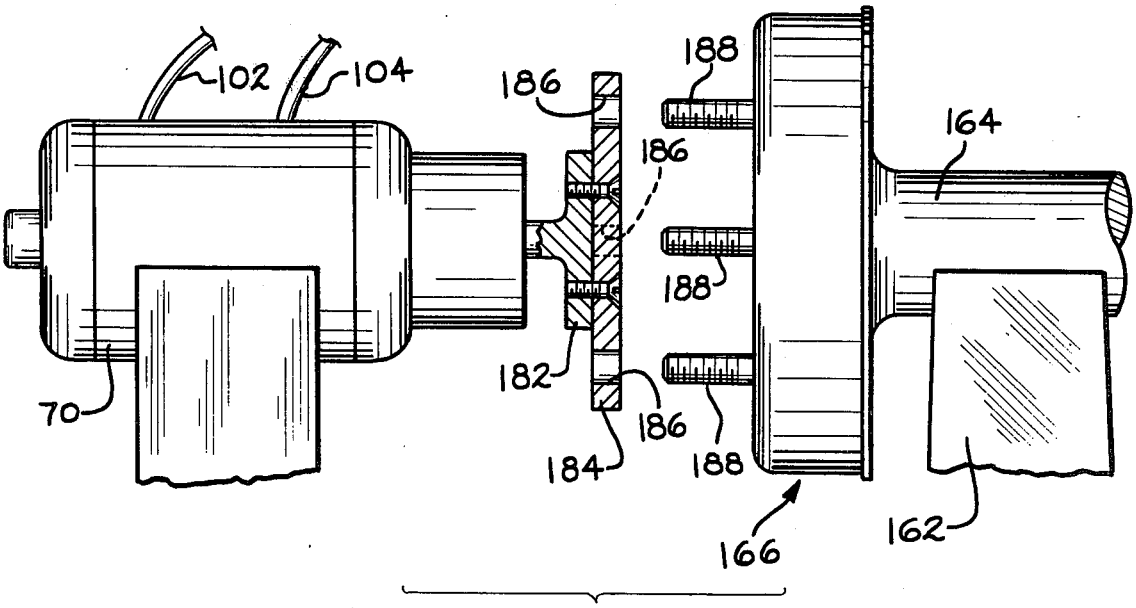
FIG. 15 is a fragmentary vertical elevational view, partly in section, showing a driving axle and wheel fastening drum to which a pump is positioned for fastening thereto.

In the embodiments of the invention described, the rotary drive means have been in engagement with the tire of the driving wheel, but it is not essential that the rotary drive means be drivingly connected to the wheel in this manner. If desired, the rotary drive means can be connected to the rear wheel drive assembly in other ways, such as by the wheel mounting bolts of the wheel mounting drum, for example. For an illustration of such an embodiment of the invention, attention is directed to FIGS. 14 and 15.

As there shown, the retaining means 158 includes the base pad 160 adapted to be positioned on the deck of the marine vessel 10. Secured to base pad 160 is the support means or cradle 162 adapted to support the rear axle housing 164 of the rear wheel drive assembly 166 from which the rear wheel has been removed. Also secured to the base pad 160 is the second support cradle 168 which has three sections 170, 172 and 174 which are respectively movable in transverse, vertical and fore-and-aft directions in response to turning of cranks 176, 178 and 180. The second support cradle 168 is adapted to support the hydraulic pump 70 which forms a part of the propulsion means, as was previously described. Secured to the plate 182 of the pump 70 is the rotary drive means 184 which in this instance is an adapter plate having bolt holes 186 corresponding to the wheel mounting bolts 188 of the drum 190. Thus, the motor vehicle of which the rear wheel drive assembly 166 is a part can readily be jacked-up at its one rear wheel, the rear wheel can be removed and after the retaining means 158 has been properly placed under the rear axle housing 164, the motor vehicle can be lowered onto the support means or cradle 162 to the position shown in FIG. 15. Thereafter, the rotary drive means can be moved into position by means of cranks 176, 178, 180 with the bolt holes 186 fitted over bolts 188. The propulsion system is now in operative connection with the motor vehicle so that the marine vessel can be propelled thereby.

It is claimed:

1. A marine vessel comprising a deck, a live turntable mounted on said deck in a fixed location and having support and positioning means for one front steering wheel of a motor vehicle, a dummy turntable positioned on said deck and laterally movable for selective positioning to support the other front steering wheel of said motor vehicle, a rudder, steering gear means connecting said live turntable and said rudder for turning the rudder in response to turning of said live turntable, retaining means freely movable to any location on the surface of said deck when unloaded for selective positioning on said deck to accommodate and when so loaded to secure one rear wheel of said vehicle against fore-and-aft movement, rotary drive means freely movable to any location on the surface of said deck when unloaded for selective positioning on said deck in juxtaposition with the other rear wheel of said vehicle so as to be rotated in response to turning of said other rear wheel when said other rear wheel is in driving relation thereto, a fluid pump connected to said rotary drive means to be turned thereby, a propeller, fluid motor means connected to said propeller for driving the propeller, and flexible coupling means connected to said fluid pump and to said fluid motor means for supplying fluid for driving said motor means in response to turning of said pump.

2. The marine vessel that is defined in claim 1, wherein said retaining means comprise chocks that are positioned in fore-and-aft relationship on the upper surface of said deck.

3. The marine vessel that is defined in claim 2, wherein said chocks are adjustable in a fore-and-aft direction to accommodate wheels of different sizes.

4. The marine vesse; that is defined in claim 1, wherein said retaining means comprise rollers that are retained in fore-and-aft relationship in a frame positioned on the upper surface of said deck.

5. The marine vessel that is defined in claim 4, wherein said rollers are adjustable in said frame in a fore-and-aft direction to accommodate wheels of different sizes.

6. The marine vessel that is defined in claim 1, wherein said coupling means includes flexible conduits so that said rotary drive means can be moved to selected positions on said deck to accommodate motor vehicles of different lengths.

7. The marine vessel that is defined in claim 1, wherein said rotary drive means comprises rollers that are retained in a fore-and-aft relationship in a frame positioned on the upper surface of said deck, and said fluid pump is connected to one of said rollers to be turned thereby.

8. The marine vessel that is defined in claim 7, wherein said rollers are adjustable relative to one another in a fore-and-aft direction to accommodate wheels of different sizes.

9. The marine vessel that is defined in claim 1, wherein said deck includes a transverse rail means in transverse alignment with said live turntable, and said dummy turntable is movable on said rail means so that said turntables can accommodate front wheels of motor vehicles having different wheel treads.

10. A marine vessel comprising a deck, a live turntable mounted in said deck in a fixed location and having support means for one front steering wheel of a motor vehicle, rail means mounted on said deck and extending in a lateral direction from said live turntable, a dummy turntable positioned on said rail means for selective lateral positioning to accommodate the other front steering wheel of said motor vehicle, said dummy turntable having support means for said other front steering wheel, said turntables each having a vertical axis of rotation and the support means associated with each turntable being adjustable radially relative to the vertical axis of its turntable, a rudder, steering gear means connecting said live turntable and said rudder for turning the rudder in response to turning of said live turntable, retaining means freely movable to any location on the surface of said deck when unloaded for selective positioning on said deck and having support means to accommodate and when so loaded to retain each of the rear wheels of said vehicle against fore-and-aft movement, one of said support means being a rotary drive means to be rotated in response to turning of the driving wheel of said motor vehicle, and propulsion means operatively connected by a flexible connection to said rotary drive means for propelling the vessel in response to turning of said rotary drive means and so that said drive means can readily be moved to any location on the surface of the deck of the vessel to accommodate the motor vehicle.

11. The marine vessel that is defined in claim 10, wherein said rotary drive means is the support means of said dummy turntable to accommodate motor vehicles having a front wheel drive.

12. The marine vessel that is defined in claim 10, wherein said rotary drive means is the support means of one of said retaining means to accommodate motor vehicles having a rear wheel drive.

13. The marine vessel that is defined in claim 10, wherein both of said retaining means for said rear wheels comprise rollers that are retained in fore-and-aft relationship to accommodate motor vehicles having limited-slip rear axle differentials providing drive through both rear wheels.

14. A marine vessel comprising a deck, a live turntable mounted on said deck in a fixed location and having support means for one front steering wheel of a motor vehicle, a rudder, steering gear means connecting said live turntable and said rudder for turning the rudder in response to turning of said live turntable, said live turntable having a fixed vertical axis of rotation and said support means being adjustable radially relative to said axis, retaining means freely movable to any location on the surface of said deck when unloaded for selective positioning on said deck and having support means for one rear wheel of said motor vehicle, said support means including a rotary drive means to be rotated in response to rotation of said rear wheel, and propulsion means operatively connected to said rotary drive means for propelling the vessel in response to turning of said rotary drive means, said propulsion means including a flexible connection to said rotary drive means so that said rotary drive means when unloaded can readily be moved to any location on the surface of the deck of the vessel to place the rotary drive means in engagement with said rear wheel of the motor vehicle.

15. A marine vessel comprising a deck, a live turntable mounted on said deck in a fixed location and having support means for one front steering wheel of a motor vehicle, said live turntable having a fixed vertical axis of rotation and said support means being adjustable radially relative to said axis, a rudder, steering gear means connecting said live turntable and said rudder for turning the rudder in response to turning of said live turntable, retaining means freely movable to any location on the surface of said deck for selective positioning on said deck having support means to accommodate and when so loaded to maintain one rear wheel drive assembly of said motor vehicle in an elevated position for rotation relative to said deck, a rotary drive means adapted to be positioned in engagement with said one rear wheel drive assembly so as to be rotated in response to rotation thereof, and propulsion means operatively connected to said rotary drive means for propelling the vessel in response to turning of said rotary drive means, said propulsion means including a flexible member leading to the operative connection with said rotary drive means so that said rotary drive means can readily be moved to any location on the surface of the deck of the vessel necessary to place the rotary drive means in engagement with said rear wheel drive assembly.

16. The marine vessel that is defined in claim 15, wherein said one rear wheel drive assembly includes a rear wheel, and said support means includes rollers that are retained in fore-and-aft relationship in a frame positioned on said deck.

17. The marine vessel that is defined in claim 15, wherein said one rear wheel drive assembly has an axle housing and a wheel mounting drum containing wheel mounting bolts, and said support means includes a support cradle adapted for supporting said axle housing, said rotary drive means including an adapter plate having bolt holes for mounting on said wheel mounting bolts and connected to said propulsion means.

18. The marine vessel that is defined in claim 17, wherein said retaining means includes a second support cradle that is adjustable relative to the first-named support cradle, said rotary drive means being supported on the second support cradle by its connection to said propulsion means.

* * * * *